United States Patent [19]

Bateman

[11] Patent Number: 4,723,076

[45] Date of Patent: Feb. 2, 1988

[54] DOUBLE FOCUSING MASS SPECTROMETERS

[75] Inventor: Robert H. Bateman, Knutsford, United Kingdom

[73] Assignee: VG Instruments Group Limited, Crawley, United Kingdom

[21] Appl. No.: 862,623

[22] Filed: May 13, 1986

[30] Foreign Application Priority Data

May 15, 1985 [GB] United Kingdom ..... 8512253

[51] Int. Cl.[4] ..... D01D 59/44

[52] U.S. Cl. ..... 250/296; 250/297

[58] Field of Search ..... 250/281, 296, 297

[56] References Cited

FOREIGN PATENT DOCUMENTS

| | | | |
|---|---|---|---|
| 64090 | 6/1978 | Japan | 250/296 |
| 2133924 | of 0000 | United Kingdom . | |
| 993362 | 1/1983 | U.S.S.R. | 250/296 |
| 1061193 | 12/1983 | U.S.S.R. | 250/296 |

OTHER PUBLICATIONS

"High-Resolution, Symmetric-Prism Mass Spectrometer", Kel'man et al., *Sov. Phys. Tech. Phys.,* vol. 21, No. 8, Aug. 1976, pp. 979-982, 250-296.

McLafferty, Todd, McGilvery et al, J. Am. Chem. Soc., 1980, vol. 102, pp. 3360-3363.

Russell, McBay, Mueller, International Laboratory, Apr. 1980, pp. 49-59.

Takeda, Shibata, Matsuda, Mass Spectroscopy 1980, vol. 28, (3), pp. 217-226.

Takeshita, I., Rev. Sci. Instrum. 1967, vol. 38, (10), pp. 1361-1367.

*Primary Examiner*—Bruce C. Anderson

*Attorney, Agent, or Firm*—Schwartz, Jeffery, Schwaab, Mack, Blumenthal & Evans

[57] ABSTRACT

There is provided a mass spectrometer having at least three analyser sectors of the electrostatic or magnetic types, at least one sector being of the electrostatic type and at least one further sector being of the magnetic type. The spectrometer includes a focusing sector array having at least three analyzer sectors, the sectors of the array being dimensioned and positioned so as to cooperate to form a velocity- and direction- focused image. The sectors of the array are dimensioned and positioned as to form no velocity focused image within the array. One sector of said array is disposed adjacent to and between two sectors of the other type.

26 Claims, 7 Drawing Figures

DOUBLE FOCUSING MASS SPECTROMETERS

BACKGROUND OF THE INVENTION

1. Field of the Invention

This invention relates to mass spectrometers, and in particular to mass spectrometers which incorporate a magnetic sector analyser.

2. Related Art

In a magnetic sector mass spectrometer, a beam of ions is deflected by a magnetic field by an amount dependent on the mass to charge ratio (m/z) of the ions. In such an instrument, ions from a source are first accelerated through an electrical potential V to an energy of $$zV=mV^2/2 \quad [1]$$

where v is the velocity of the ion after acceleration. On passing through the magnetic field, which is disposed perpendicular to the plane in which the ions are travelling, the ions experience a centrifugal force $mv^2/r$, where r is the radius of curvature of the path of the ions in the magnetic field. If the magnetic field strength is B, the force exerted by it is Bzv, so that $$Bzv=mv^2/r \quad [2]$$

Combining equations [1] and [2], $$m/z=(B^2r^2)/2V \quad [3]$$

In practice, r is fixed by the use of 2 narrow slits in fixed positions relative to the magnetic field, and V is held constant, so that ions of different m/z ratios are selected by changing the magnetic field B. Thus the effect of the magnetic field can be compared with that of a prism which disperses a beam of white light into its spectral components. A magnetic field can also be arranged to provide a direction focusing effect on a beam of ions, in the same way as does an optical lens with a beam of light. Thus it can be made to form an image of a source of ions at the same time as it separates that beam into its components of different m/z ratios; that is, a series of focused images, each corresponding to ions of different m/z ratios, can be produced. In order to achieve this directional focusing behaviour it is of course necessary to appropriately position the object and image slits and select the shape of the magnetic field, exactly as it is in the case of an optical lens used to produce an optical image. The theory and practice of the methods used are well known. Magnetic sector mass spectrometers which utilize the directional focusing properties of the magnetic field as well as its dispersive properties in order to obtain the sharpest possible image and hence the highest mass resolution are known as single focusing mass spectrometers.

No matter how carefully a single focusing mass spectrometer is designed, however, its resolution is always limited by the spread in the velocity of ions of the same m/z ratio which pass through the object slit into the magnetic field. In practice, the commonly used ion sources produce an energy spread of several electron volts, and the resulting energy variations in the accelerated ion beam (typically 3–10 keV) usually limits the resolution to about 3,000 (10% valley definition). In order to achieve high resolution, it is necessary to use an energy selecting device in conjunction with the magnetic sector analyser. The most common type employed consists of a sector formed of two cylindrical plates spaced a constant distance apart with an electrical potential gradient (E) maintained between them. If the radius of the path of the ion beam between the plates is $r_e$, then the force experienced by the ions is given by $$zE=mv^2/r_e \quad [4]$$

whilst the energy possessed by the ion is given by equation [5], as in the case of the magnetic sector analyser.

$$zV=mv^2/2 \quad [5]$$

Combining these equations, it is found that $$r_e=2V/E \quad [6]$$

so that an electrostatic sector analyser of this kind disperses an ion beam according to the translational energies of the ions of which it is formed. If $r_e$ is fixed by the use of narrow slits, then the electrostatic sector analyser can be used to select ions of a particular energy from a beam having a significant spread of energies. As in the case of a magnetic sector analyser, an electrostatic analyser can also provide direction focusing of the beam providing that the object and image slits are correctly positioned and the field itself is properly shaped. Use of this focusing behaviour clearly enhances the resolution of the analyser.

High resolution mass spectrometers therefore employ both an electrostatic sector and a magnetic sector analyser in series in order to provide both mass and energy filtration of the ion beam. It is well known that in spectrometers of this type particular combinations of electrostatic and magnetic sectors also result in velocity focusing of an ion beam as well as direction focusing; in other words an ion beam of one m/z ratio entering the first analyser within a certain range of incident angles and having an energy lying within a certain range of values will be accurately focused to the same point on the exit focal plane of the second analyser. Mass spectrometers of this type are known as double focusing mass spectrometers, and are capable of resolutions in excess of 100,000 (10% valley definition). The methods used to design double focusing mass spectrometers are well known in the art. Known spectrometers of this kind fall into two classes. Those having Nier-Johnson geometry, illustrated in FIG. 1, have a geometrical arrangement such that a real, direction focused image is formed by the first analyser, and this image serves as the object of the second analyser. This corresponds to the formation of a real image by a convex optical lens when the object is situated at a distance from the lens greater than its focal length. Similarly, a real image is formed by the second analyser at the detector.

Spectrometers having Mattauch-Herzog geometry, illustrated in FIG. 2, do not form a real intermediate image. Instead, the image of the first sector is arranged to be at infinity, and the object distance of the second analyser is also arranged to be infinity, so that a real image is formed by the second analyser at a distance equal to its focal length. This arrangement in general provides a smaller instrument than the Nier-Johnson geometry for a similar performance and is well adapted to provide an extended focal plane along which a photographic plate or a multichannel detector can be positioned so that the entire spectrum can be recorded simultaneously.

Obviously, the focusing actions described above are imperfect, and suffer from aberrations, as do those of simple optical lenses. Many of these aberrations can be predicted theoretically and can be minimized by further selection of the positions and shapes of the fields and by fixing certain critical dimensions. Additional magnetic and/or electrostatic lenses can also be incorporated to correct certain of the aberrations. Other aberrations in focusing behaviour, particularly those due to the fringing fields at the entrance and exit of the analysers, are difficult to predict but can be minimized by experimental adjustments. Once again, the principles involved in designing spectrometers to minimize the second and higher order aberrations are well known, but it will be appreciated that because many design parameters have to be fixed in order to minimize the predictable aberrations, the number of possible designs for a very high performance double focusing mass spectrometer is limited. For example, Hinternberger and Konig, (in Advances in Mass Spectrometry, vol. I, 1959, P16–35) have given details of a method used for designing spectrometers corrected for image defects to the second order, and have also proposed many of the practical designs which are possible. High performance double focusing spectrometers according to some of these designs are commercially available. In every case they consist of an electrostatic sector analyser and a magnetic sector analyser, and it should be noted that double focusing behaviour can be obtained with the sectors in any order.

A technique of mass spectrometry which is gaining rapidly in popularity is that of tandem mass spectrometry, often abbreviated to MS/MS. It is used to study the fragmentation of ions, which is usually induced by causing them to collide with molecules of an inert gas in a collision cell, producing fragment ions of various mass/charge ratios and kinetic energies. There are several variations of the technique, which is described in detail in "Tandem Mass Spectrometry", edited by F. W. McLafferty, published by Wiley, New York, 1983. A typical tandem mass spectrometry experiment involves the production of a primary ion beam from a sample, filtration of the beam to produce a beam of ions of a particular m/z value, the passage of this beam through a collision gas cell to induce fragmentation of the ions, and the subsequent mass or kinetic energy analysis of the fragment ions. Experiments of this kind yield useful information on the chemical composition of the sample, and can provide a very specific and sensitive method for the determination of trace components in a complex mixture.

It is possible to utilize a conventional two-sector double focusing mass spectrometer for tandem mass spectrometry if a collision cell is inserted between the two sectors and the first sector is used to filter the primary ion beam while the second sector is used to provide a mass or energy spectrum of the fragment ions. However, the method has the disadvantage that spurious peaks frequently appear in the spectrum due to the passage through one or both of the sectors of ions formed by fragmentation processes other than the one under investigation, sometimes occurring in other parts of the spectrometer. The presence of these "artefact" peaks can result in serious errors in the interpretation of the resultant spectrum. It is well known that their occurrence can be minimized by using spectrometers having three or more sectors, and instruments having a wide range of configurations have been constructed. For example, denoting a magnetic sector as B, an electrostatic sector as E, a quadrupole mass analyser as Q, and a high efficiency quadrupole collision cell as Qc, instruments having the following configurations are known:

| | | |
|---|---|---|
| BEB | BEQ | BEQcQ |
| EBE | EBQ | EBQcQ |
| EBEB | EQcQ | |
| BEEB | QQcQ | |

Details of the various types of instruments can be found in the following references:

(1) McLafferty, F. W., Todd, PJ, McGilvery, D. C., Baldwin, M. A., J. Am. Chem. Soc. 1980, vol. 102, p 3360–63.

(2) Russell, D. H, McBay, E. H., Mueller, T. R., International Laboratory, April 1980, p 50–51.

Of the above, the three sector BEB and EBE combinations comprise a conventional two sector high resolution primary stage and a low resolution single sector mass or energy analyser following the collision cell. If such an instrument is used without the collision cell, so that the primary beam passes into the third sector, the final image is not velocity focused and consequently a lower resolution will be achieved in comparison with the resolution achievable at the velocity focused intermediate image. BEB instruments can also be configured with the collision cell after the first sector, so that a low resolution primary stage and a high resolution double focusing secondary stage are provided. Use of this type of instrument without the collision cell also produces a lower resolution final image than could be achieved with the second stage alone, because the image produced by the first stage is not velocity focused. Of course the resolution can be improved by fitting a narrow slit at the intermediate image position, but this clearly would reduce the transmission efficiency of the instrument and hence its sensitivity.

Four sector EBEB and BEEB combinations have the collision cell situated between the second and third sectors and thus comprise two double focusing spectrometers in series, with the velocity focused image produced by the first stage serving as the object of the second stage. When used without the collision cell, these instruments clearly produce a velocity focused image, but because of aberration in the first stage this is bound to be of lower resolution than the intermediate image unless an intermediate slit is provided, which reduces sensitivity.

Thus it will be seen that there is no advantage to be gained by using any conventional multiple-sector tandem instrument without a collision cell in comparison with a straightforward two sector double focusing spectrometer. Indeed, the resolution, or sensitivity, or both, will be reduced by so doing. This is in marked contrast with instruments constructed according to the present invention in which all sectors co-operate to produce a final velocity focused image.

Another type of spectrometer having EBE geometry has been described by Takeda, T, Shibata, S, and Matsuda, H, in Mass Spectroscopy (Japan), 1980, vol. 28 pt. 3, p 217–226. In this instrument the second electrostatic sector is used only for deflecting low mass ions on to the same detector used for higher mass ions, and is not used to provide any energy dispersive action. Another two stage tandem mass spectrometer in which the first stage is a conventional EB double focusing geometry analyser and the second stage is a cross field EB analyser is described in GB patent publication No. 2123924A. This instrument is similar to the four sector EBEB and BEEB configurations described previously.

Yet another type of multiple sector mass spectrometer has been described by I. Takeshita in review of Scientific Instruments, 1967, vol. 38 (10) pp 361, and in papers referred to therein. Takeshita describes a range of Mattauch-Herzog type spectrometers which comprise two electrostatic sectors preceding a single magnetic sector, which combination can be arranged to produce a velocity and direction focused final image. The object to Takeshita's designs is to overcome a defect of the simple two-sector Mattauch-Herzog design, namely that because no image is formed between the sectors the velocity spread of the ion beam cannot be adjusted independently of the beam divergence. Takeshita's designs require the two electrostatic sectors to be adjacent to one another and for a direction focused image to be formed either between the two sectors, where a slit can be fitted, or inside one of them (in certain special cases where the need for a slit can be obviated). No designs are presented where both those requirements are not met.

A well known difficulty encountered when using a magnetic sector mass spectrometer for organic chemical analysis is the limitation imposed on the speed of scanning the spectrum by the hysteresis of the magnet core. Although there have been many improvements recently made possible by the use of laminated cores and very low resistance coils, the difficulty of relating the actual mass/charge ratio being transmitted to the demanded mass during a fast scan seriously limits the maximum speed attainable. Indeed adequate results can be obtained only through the use of complicated electronic circuitry and by the introduction of reference samples to calibrate the mass scale, sometimes simultaneously with the sample. The selection of suitable reference samples often presents a severe problem. These difficulties could be reduced by using an electromagnet which did not have a ferromagnetic core, but up to now, the strength of the field required to provide an adequate mass range for organic chemical analysis using any of the known double focusing geometries has precluded this. It is an object of the present invention, therefore, to provide a mass spectrometer suitable for organic chemical analysis having double focusing properties which requires a low enough magnetic field to permit the use of a magnet without a ferromagnetic core.

SUMMARY OF THE INVENTION

Important objects and advantages of the invention will become apparent in the detailed description of the invention given below.

According to one aspect of the invention there is thus provided a mass spectrometer having at least three analyser sectors of the electrostatic or magnetic types, at least one said sector being of the electrostatic type and at least one further said sector being of the magnetic type, wherein said spectrometer comprises a focusing sector array comprising at least three of said sectors, said sectors of said array being dimensioned and positioned so as to cooperate to form a velocity- and direction-focused image and said sectors of said array being so dimensioned and positioned as to form no velocity focused image within said array, and wherein one said sector of said array is disposed adjacent to and between two sectors of the other type.

By a sector being adjacent to and between two other sectors of the other type it is meant that on the ion flight path the sectors immediately before and immediately after the sector in question are of the type other than that of the sector in question, ie the sector sequence BEB or EBE exists.

Viewed from another aspect, the invention provides a mass spectrometer having at least three analyser sectors of the electrostatic or magnetic types, at least one said sector being of the electrostatic type and at least one further said sector being of the magnetic type, wherein said spectrometer comprises a focusing sector array comprising at least three of said sectors, said sectors of said array being dimensioned and positioned so as to cooperate to form a velocity- and direction-focused image and said sectors of said array being so dimensioned and positioned as to form no direction focused image in said array. Preferably, in this embodiment, one of the sectors of the array is disposed adjacent to and between two sectors of the other type.

Preferably also the spectrometer of the invention comprises one magnetic analyser sector and two electrostatic analyser sectors, disposed in an EBE configuration so that no intermediate direction or velocity focused images are formed. For convenience, the spectrometer is regarded as being divided into two parts by a plane at right angles to the motion of the ions through the spectrometer and which passes through the point of intersection of normals to the central trajectory of ions passing through the central magnetic sector analyser at the intersection of the entrance and exit boundaries of the magnetic field with said central trajectory, and which makes angles $\phi_{m1}$ and $\phi_{m2}$ respectively with each of said normals such that the trajectories of all ions of a particular m/z ratio but of different energies are parallel to each other at the points at which they cross said plane. The dimensions and positions of the sector analysers are then selected to satisfy the following equations:

$$\frac{\sin(\phi_{m1}-\epsilon')}{\cos\epsilon'}\left[\frac{r_{e1}}{r_m}(1-\cos\sqrt{2}\,\phi_{e1})+\frac{\sqrt{2}\,d_1}{r_m}\cdot\sin\sqrt{2}\,\phi_{e1}\right]-\sqrt{2}\sin\sqrt{2}\,\phi_{e1}\cos\phi_{m1}+\sin\phi_{m1}=0 \quad [7]$$

and $$\frac{\sin(\phi_{m2}-\epsilon'')}{\cos\epsilon''}\left[\frac{r_{e2}}{r_m}(1-\cos\sqrt{2}\,\phi_{e2})+\frac{2d_2}{r_m}\cdot\sin\sqrt{2}\,\phi_{e2}\right]-\sqrt{2}\sin\sqrt{2}\,\phi_{e2}\cos\phi_{m2}+\sin\phi_{m2}=0 \quad [8]$$

in which $r_{e1}$ is the radius of the 1st electrostatic analyser sector, $r_{e2}$ is the radius of the 2nd electrostatic analyser sector, $r_m$ is the radius of the central magnetic analyser sector, $\phi_{e1}$ is the sector angle of the 1st electrostatic sector, $\phi_{e2}$ is the sector angle of the 2nd electrostatic sector, $\phi_{m1}$, $\phi_{m2}$ are as defined above, $\epsilon'$ is the angle of inclination of the entrance boundary of the magnetic sector to the normal at the entrance boundary defined above, $\epsilon''$ is the angle of inclination of the exit boundary of the magnetic sector to the normal at the exit boundary defined above, $d_1$ is the distance between the exit boundary of the first electrostatic sector and the entrance boundary of the magnetic sector, measured along the central trajectory, $d_2$ is the distance between the entrance boundary of the second electrostatic sector and the exit boundary of the magnetic sector, measured along the central trajectory.

According to a further preferred form, the angles $\epsilon'$ and $\epsilon''$ are equal to zero so that the spectrometer is constructed to satisfy the equations:

$$\tan\phi_{m1} = \frac{\sqrt{2}\sin\sqrt{2}\,\phi_{e1}}{\frac{r_{e1}}{r_m}(1-\cos\sqrt{2}\,\phi_{e1}) + \sqrt{2}\cdot\frac{d_1}{r_m}\cdot\sin\sqrt{2}\,\phi_{e1} + 1} \quad [9]$$

and $$\tan\phi_{m2} = \frac{\sqrt{2}\sin\sqrt{2}\,\phi_{e2}}{\frac{r_{e2}}{r_m}(1-\cos\sqrt{2}\,\phi_{e2}) + \sqrt{2}\cdot\frac{d_2}{r_m}\cdot\sin\sqrt{2}\,\phi_{e2} + 1} \quad [10]$$

According to a still further preferred form, the spectrometer is made symmetrical, so that $d_1=d_2=d$, $\phi_{e1}=-\phi_{e2}=\phi_e$, $r_{e1}=r_{e2}=r_e$ and $\phi_{m1}=\phi_{m2}=\phi_m/2$ (the magnetic sector angle) so that the equation $$\tan\frac{\phi_m}{2} = \frac{\sqrt{2}\sin\sqrt{2}\,\phi_e}{\frac{r_e}{r_m}(1-\cos\sqrt{2}\,\phi_e) + \frac{2d}{r_m}\cdot\sin\sqrt{2}\,\phi_e + 1} \quad [11]$$

is satisfied.

A still further preferred form of the spectrometer has the radius of the magnetic sector ($r_m$) much greater than, e.g. 5 or more times, the radius of the electrostatic sectors ($r_e$) and the distance (d) between the sectors, so that the equation $$\tan\phi_m/2 \sim \sqrt{2}\sin\sqrt{2}\,\phi_e \quad [12]$$

is approximately satisfied. This embodiment is especially suited to use with an air cored magnet which has a limited magnetic field strength and therefore requires a large radius $r_m$ in order for the spectrometer to have adequate mass range.

According to another form of the invention, one electrostatic sector analyser and two magnetic sector analysers are disposed in a BEB configuration, so that no velocity focused images are formed between the sectors and both direction and velocity focusing is achieved by the combination of all three sectors. For convenience the spectrometer is regarded as being divided into two parts by a plane at right angles to the motion of the ions through the spectrometer, which passes through the intersection of projections of the boundaries of the electrostatic field, and which makes angles $\phi_{e1}$ and $\phi_{e2}$ with the projections of the entrance and exit boundaries, respectively, such that the trajectories of all ions of a particular m/z ratio but of different energies are parallel to each other at the points where they cross said plane. The dimensions and positions of the sector analysers are then selected to satisfy the following equations:

$$\sqrt{2}\tan\sqrt{2}\,\phi_{e1}\left[\frac{r_{m1}}{r_e}(1-\cos\phi_{m1}) + \frac{d_1}{r_e}\tan\epsilon_1'' + \frac{\sin(\phi_{m1}-\epsilon_1'')}{\cos\epsilon_1''} + 1\right] - \left[\tan\epsilon_1'' + \frac{\sin(\phi_{m1}-\epsilon_1'')}{\cos\epsilon_1''}\right] = 0 \quad [13]$$

and $$\sqrt{2}\tan\sqrt{2}\,\phi_{e2}\left[\frac{r_{m2}}{r_e}(1-\cos\phi_{m2}) + \frac{d_2}{r_e}\tan\epsilon_2' + \frac{\sin(\phi_{m2}-\epsilon_2')}{\cos\epsilon_2'} + 1\right] - \left[\tan\epsilon_2' + \frac{\sin(\phi_{m2}-\epsilon_2')}{\cos\epsilon_2'}\right] = 0 \quad [14]$$

in which $\phi_{m1}$ is the sector angle of the first magnetic analyser sector, $\phi_{m2}$ is the sector angle of the second magnetic analyser sector, $\phi_{e1}$ and $\phi_{e2}$ are as defined above, $r_{m1}$ is the radius of the first magnetic analyser sector, $r_{m2}$ is the radius of the second magnetic analyser sector, $r_e$ is the radius of the central electrostatic analyser sector, $d_1$ is the distance between the exit boundary of the first magnetic sector and the entrance boundary of the electrostatic analyser, $d_2$ is the distance between the entrance boundary of the second magnetic sector and the exit boundary of the electrostatic analyser, $\epsilon_1''$ is the angle of inclination of the exit boundary of the first magnetic sector to the normal to the central trajectory of this sector at the point where the central trajectory cuts the magnetic sector exit boundary, $\epsilon_2'$ is the angle of inclination of the entrance boundary of the second magnetic analyser sector to the normal to the central trajectory of this sector at the point where the central trajectory cuts the magnetic sector entrance boundary.

As in the case of the EBE configuration, the preferred form of the instrument is with $\epsilon_1''$ and $\epsilon_2'=0$, $\phi_{m1}=\phi_{m2}=\phi_m$, $\phi_{e1}=\phi_{e2}=\phi_e/2$, $d=d_1=d_2$, and $r_{m1}=r_{m2}=r_m$. A spectrometer having these features therefore satisfies the equation:

$$\tan\frac{\phi_e}{2} = \frac{\sin\phi_m}{\sqrt{2}\left[\frac{r_m}{r_e}(1-\cos\phi_m) + \frac{d}{r_e}\cdot\sin\phi_m + 1\right]} \quad [15]$$

It is possible to use a similar method to design other multiple sector mass spectrometers which produce a final image which is velocity focused without any intermediate velocity focused images. First, the desired arrangement of sectors is divided into two parts by an imaginary plane so that each part contains at least one sector and at least part of another sector of the other type. The plane is drawn in such a way that the trajectories of all ions crossing it intersect it at 90°. Along this plane the angular deviation $y_1'$ is 0. The known transfer matrices for each section of the spectrometer from the ion source to the plane are then used to obtain $y_1'$ at the plane, which is then equated to 0. The part of the spectrometer on the other side of the plane is treated in the same way, and the critical relationships between the sectors needed for first order focusing and the production of a final velocity focused image can be found. It is obvious, however, that not every combination of sectors will permit such a plane to be drawn. Of those that will, it is thought that EBEBE and EEBEE combinations would have particularly useful properties, but others are not excluded.

It will be further realized that in order to produce a complete design for a spectrometer, the equations previously given are not the only equations which have to be satisfied. In particular, it is necessary to calculate the distances from the ion source and ion detector to the first and last analyser sectors respectively, in order to achieve first order double focusing. The method of doing this is well known in the art, and an example is given later for the most preferred form of the invention. Further, it is within the scope of the invention to further select the parameters not fixed by any of equations [7]-[15] to minimize the second order aberrations in the focusing behaviour, following the procedures similar to those used in the design of high performance two sector double focusing instruments. Other lenses and variable parameters may be introduced in the instrument in order to provide correction for second order aberrations.

Thus, use of a spectrometer according to the invention allows the construction of a double focusing spectrometer of high performance having a very high $r_m$ and relatively small $\phi_m$. This is ideally suited to the use of a magnet with a non-ferromagnetic core. However, the object and image distances of such an arrangement are large, as will be shown later, so that a further preferred version of the invention comprises a double focusing mass spectrometer as defined above comprising electrostatic lenses disposed between the ion source of the spectrometer and the entrance boundary of the first analyser sector of the array and between the exit boundary of the last analyser sector of the array and the ion detector, said electrostatic lenses being arranged to reduce the object distance of said first analyser and the image distance of said last analyser. The lenses permit substantial reduction of the object and image distances while allowing both direction and velocity focusing to be maintained. Preferably also, further electrostatic zoom lenses are provided in order to vary the effective width of the object and image slits of the spectrometer in order to eliminate the need for slits of adjustable width operable from outside the vacuum envelope of the spectrometer.

According to a further feature, the invention comprises a mass spectrometer as defined above in which said magnetic sector, or at least one of said magnetic sectors, is equipped with an electromagnet having a core of a non-ferromagnetic material. Preferably the electromagnet is air cored, and furthermore it preferably comprises two flat coils disposed either side of the plane in which the ions travel during their passage through the magnetic sector.

Thus the invention provides a mass spectrometer having double focusing properties which is suitable for use as a tandem mass spectrometer, and which is adapted to substantially reduce the spurious peaks which are frequently formed when a two sector double focusing mass spectrometer is used in this way. Furthermore, the invention provides a physically small mass spectrometer which has double focusing properties and in which the electrostatic analyser sector or sectors are so short that the plates forming them need not be curved, as in a conventional electrostatic analyser, thereby greatly simplifying their manufacture.

By using the geometry described, a compact double focusing mass spectrometer of medium-high resolution can be constructed with a magnetic sector radius greater than 500 mm, which permits the use of an electromagnet with a low field strength (e.g. 0.1 T) while still maintaining an adequate mass range for organic chemical analysis. This field strength can be obtained using an air-cored magnet, which has negligible hysteresis, allowing the entire mass range to be scanned much more quickly and reproducibly than is possible with a conventional iron cored magnet. The lack of hysteresis, and the consequent ease of relating the transmitted m/z ratio to the current through the magnet coils, eliminates the need for frequent calibration of the mass range of the spectrometer by means of reference compounds.

Further, the presence of the electrostatic analyser on each side of the magnetic analyser in the preferred embodiment provides electrostatic filtration of the ion beam before and after mass selection in the magnet. Thus, if a collision gas cell is positioned between the ion source and the first electrostatic analyser, tandem mass spectrometry experiments can be carried out without the formation of the spurious peaks which detract from tandem mass spectrometer experiments carried out on conventional two sector instruments, despite the lack of any filtration of the primary ion beam. In this respect, the mass spectrometer of the invention behaves in the same way as an EBE type tandem mass spectrometer previously described in which the collision gas cell is located before the first analyser.

A further simplification in construction which can be achieved in the preferred embodiment of the invention is a consequence of the very small sector angles of the electrostatic analysers which are required by the preferred embodiment. This means that the length of the sectors is very small compared with the radius of the ion beam path through them, so that in practical design short straight plates can be used in place of the conventional cylindrical plates which are difficult to manufacture. This simplification greatly reduces the cost of manufacture of the spectrometer.

BRIEF DESCRIPTION OF THE DRAWINGS

An embodiment of the invention will now be described by way of example only and with reference to the accompanying figures, in which.

DESCRIPTION OF PREFERRED EMBODIMENTS

Figure 1:
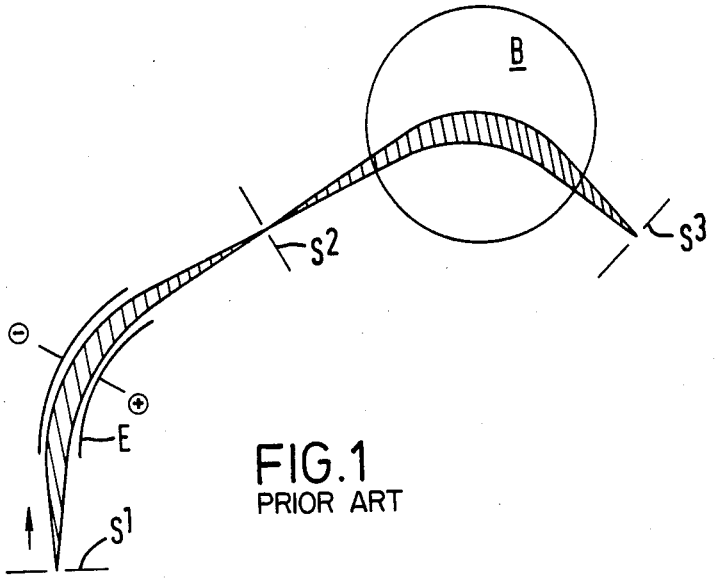
FIG.1 PRIOR ART
FIG. 1 is a simplified diagram of the ion optical arrangement of a Nier-Johnson type of double focusing mass spectrometer.
Figure 2:
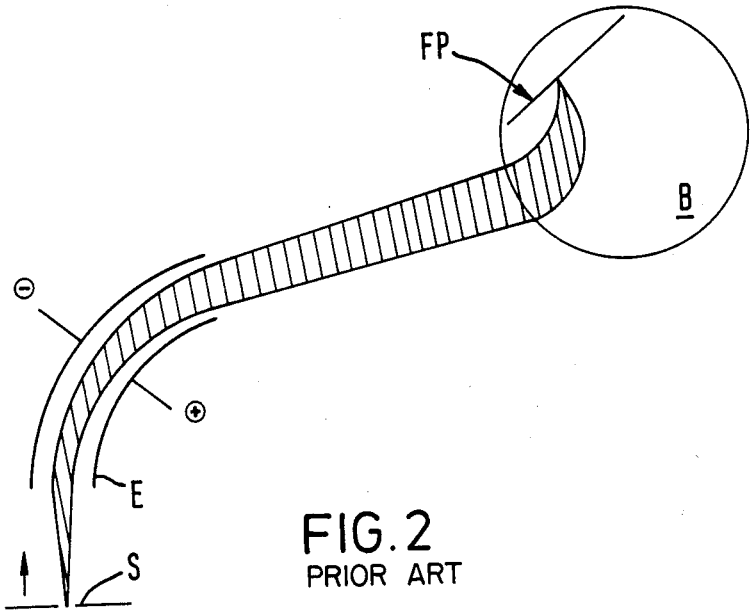
FIG.2 PRIOR ART
FIG. 2 is a simplified diagram of the ion optical arrangement of a Mattauch-Herzog type of double focusing mass spectrometer.

Referring to FIG. 1, in the Nier-Johnson spectrometer arrangement, ions from an ion source (not shown) pass through slit $S^1$ and are focused by electrostatic sector E to form a real image at slit $S^2$ before passing between the plates of magnetic sector B to be focused at slit $S^3$. In the Mattauch-Herzog arrangement, as shown in FIG. 2, ions from an ion source (not shown) pass through slit S and are focused by electrostatic sector E and magnetic sector B on focal plane FP.

It is convenient to represent the starting parameters of an ion entering a region of free space, a magnetic sector, or an electrostatic sector as $y_o$, $y_o'$, $\beta$ and $\gamma$, where $y_o$ is the y co-ordinate of the ion it enters the sector, $y_o'$ is the angular deviation of is trajectory from the central trajectory of the analyser sector, $\beta$ is its deviation from the velocity of an ion travelling along the central trajectory, and $\gamma$ is its deviation in momentum from that of an ion travelling along the central trajectory. Similarly, the co-ordinates of the ion as it leaves the sector or region of free space are defined as $y_1$, $y_1'$, $\beta$ and $\gamma$. First order transfer matrices which relate the exit parameters to the entrance parameters for each sector and for free space are well known and can be expressed as below. Note that the z co-ordinates do not enter into the first order matrices.

(a) free space:

$$\begin{bmatrix} y_1 \\ y_1' \\ \beta \\ \gamma \end{bmatrix} = \begin{bmatrix} 1 & L & 0 & 0 \\ 0 & 1 & 0 & 0 \\ 0 & 0 & 1 & 0 \\ 0 & 0 & 0 & 1 \end{bmatrix} \begin{bmatrix} y_o \\ y_o' \\ \beta \\ \gamma \end{bmatrix}$$

(b) electrostatic sector:

$$\begin{bmatrix} y_1 \\ y_1' \\ \beta \\ \gamma \end{bmatrix} = \begin{bmatrix} k_{1b} & k_{1a} & k_{2a}\cdot r_e & 0 \\ \lambda_{1b}/r_e & \lambda_{1e} & \lambda_{2a} & 0 \\ 0 & 0 & 1 & 0 \\ 0 & 0 & 0 & 1 \end{bmatrix} \begin{bmatrix} y_o \\ y_o' \\ \beta \\ \gamma \end{bmatrix}$$

(c) magnetic sector:

$$\begin{bmatrix} y_1 \\ y_1' \\ \beta \\ \gamma \end{bmatrix} = \begin{bmatrix} \mu_{1b} & \mu_{1a}\cdot r_m & \mu_{2a}\cdot r_m & \frac{1}{2}\mu_{2a}\cdot r_m \\ \nu_{1b}/r_m & \nu_{1a} & \nu_{2a} & \frac{1}{2}\nu_{2a} \\ 0 & 0 & 1 & 0 \\ 0 & 0 & 0 & 1 \end{bmatrix} \begin{bmatrix} y_o \\ y_o' \\ \beta \\ \gamma \end{bmatrix}$$

In these matrices, L is the distance travelled through the region of free space, $r_e$ is the radius of the electrostatic sector, and $r_m$ is the radius of the magnetic sector. The remaining constants are given by $$k_{1b} = \cos\sqrt{2}\,\phi_e$$

$$k_{1a} = \sin\sqrt{2}\,\phi_e/\sqrt{2}$$

$$k_{2a} = (1 - \cos\sqrt{2}\,\phi_e)$$

$$\lambda_{1b} = -\sqrt{2}\sin\sqrt{2}\,\phi_e$$

$$\lambda_{1a} = \cos\sqrt{2}\,\phi e$$

$$\lambda_{2a} = \sqrt{2}\sin\sqrt{2}\,\phi e$$

$$\mu_{1b} = \cos(\phi_m - \epsilon')/\cos\epsilon'$$
$$\mu_{1a} = \sin\phi_m$$
$$\mu_{2a} = (1 - \cos\phi_m)$$
$$\nu_{1b} = -\sin(\phi_m - \epsilon' - \epsilon'')/\cos\epsilon'\cdot\cos\epsilon''$$
$$\nu_{1a} = \cos(\phi_m - \epsilon'')/\cos\epsilon''$$
$$\nu_{2a} = \tan\epsilon'' + \sin(\phi_m - \epsilon'')/\cos\epsilon''$$

in which $\phi_e$ is the sector angle of the electrostatic sector, $\phi_m$ is the sector angle of the magnetic sector, and $\epsilon'$ and $\epsilon''$ are the entry and exit angles, respectively, of the magnetic field boundaries (measured with respect to a normal at the point of intersection of the central trajectory with the field boundary).

Figure 3:
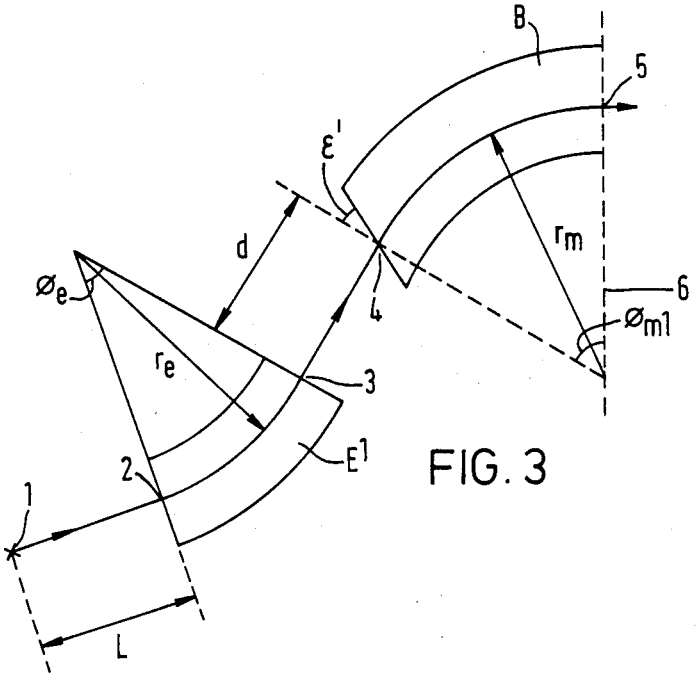
FIG. 3 is a simplified diagram of one-half of a spectrometer constructed according to the preferred embodiment of the invention having an EBE configuration, and showing the parameters used to obtain overall velocity focusing.

Referring next to FIG. 3, which shows one-half of a spectrometer according to the preferred embodiment of the invention, having an EBE configuration, and considering the first region of free space from the ion source 1 to the electrostatic sector $E^1$ for an ion of $y_o=0$, $y_o'=0$, and $\gamma=0$, then it is seen that at the exit 2 of the first region, $$y_1=(1.y_o+L.y_o'+0.\beta+0.\gamma)=0 \quad [16]$$

and $$y_1'=(0.y_o+1.y_o'+0.\beta+0.\gamma)=0 \quad [17]$$

Similarly, for the electrostatic sector, the parameters at the exit 3 are given by $$y_1 = (k_{1b}\cdot y_o + k_{1a}\cdot r_e\cdot y_o' + k_{2a}\cdot r_e\beta + 0\cdot\gamma) \quad [18]$$

and $$y_1' = \left(\frac{\lambda_{1b}}{r_e}\cdot y_o + \lambda_{1a}\cdot y_o' + \lambda_{2a}\cdot + 0\cdot\gamma\right) \quad [19]$$

Taking the values of $y_o$ and $y_o'$ as the values of $y_1$ and $y_1'$ obtained from equations [16] and [17], the parameters at point 3 are seen to be $$y_1 = k_{2a}\cdot\beta\cdot r_e = (1 - \cos\sqrt{2}\,\phi_{e1})\cdot\beta\cdot r_e \quad [20]$$

and $$y_1' = \lambda_{2a} = \sqrt{2}\cdot\sin\sqrt{2}\,\phi_e\cdot\beta \quad [21]$$

Applying the transfer matrix for free space between points 3 and 4, and taking $y_o$ and $y_o'$ for this matrix as $y_1$ and $y_1'$ from equations [20] and [21], respectively, $$y_1 = (y_o + d \cdot y_o' + 0 \cdot \beta + 0 \cdot \gamma) \quad [22]$$
$$= (1 - \cos\sqrt{2}\,\phi e) \cdot r_e \cdot \beta + \sqrt{2}\sin\sqrt{2}\,\phi_e \cdot d \cdot \beta$$

and $$y_1' = (0 \cdot y_o + 1 \cdot y_o' + 0 \cdot \beta + 0 \cdot \gamma) \quad [23]$$
$$= \sqrt{2}\sin\sqrt{2}\,\phi_e \cdot \beta$$

where d is the distance between the exit of the electrostatic sector and the entrance of the magnetic sector B (shown in part in FIG. 3). Finally, applying the transfer matrix for a magnetic sector between points 4 and 5, and taking as $y_o$ and $y_o'$ the values of $y_1$ and $y_1'$ from equations [22] and [23]. the $y_1'$ parameter of the point 5 is given by $$y_1' = \frac{\nu_{1b}}{r_m} \cdot y_o + \nu_{1a} \cdot y_o' + \nu_{2a} \cdot \beta + \tfrac{1}{2}\nu_{2a} \cdot \gamma) \quad [24]$$
$$= + \frac{\sin(\phi_{m1} - \epsilon' - \epsilon'')}{\cos\epsilon' \cdot \cos\epsilon''} \cdot \frac{1}{r_m}[(1 - \cos\sqrt{2}\,\phi_e) \cdot r_e +$$
$$\sqrt{2}\sin\sqrt{2}\,\phi_e \cdot d]\beta - \frac{\cos(\phi_{m1} - \epsilon'')}{\cos\epsilon''} \cdot \sqrt{2}\sin\sqrt{2}\,\phi_e +$$
$$\tan\epsilon'' + \frac{\sin(\phi_{m1} - \epsilon'')}{\cos\epsilon''}$$

In equation [24], $r_m$ is taken as negative because the magnetic sector bends the ion beam in the opposite direction to that caused by the electrostatic sector, and $\epsilon''$ is the exit angle of part of the magnetic sector (at point 5). In a spectrometer constructed according to the invention, the imaginary boundary 6 is selected so that $\epsilon''=0$ and the central trajectory intersects the boundary 6 at 90°, at point 5. It can be shown that the trajectories of ions having different values of $\beta$ all cross boundary 9 at 90° and hence are parallel to each other along this boundary. Therefore all ions of a given m/z ratio will cross this boundary with $\epsilon''=0$. In the preferred embodiment the second half of the spectrometer is a mirror image of the first half, and the condition for overall double focusing is simply given by equating the $y_1'$ parameters at point 5 to zero, assuming that the second half is treated in the same way as the first half already described, but starting at the ion detector.

Thus, with $\epsilon''=0$, equation [24] simplifies to $$y_1' = \frac{\sin(\phi_{m1} - \epsilon_1')}{\cos\epsilon_1'}\left[\frac{r_{e1}}{r_m}(1 - \cos\sqrt{2}\,\phi_{e1}) + \right. \quad [25]$$
$$\left.\sqrt{2} \cdot \frac{d_1}{r_m} \cdot \sin\sqrt{2}\,\phi_{e1}\right] - \sqrt{2}\sin\sqrt{2}\,\phi_{e1} \cdot \cos\phi_{m1} \cdot + \sin\phi_{m1}$$
$$= 0 \text{ (for double focusing)}$$

In equation [25], $\phi_{e1}$, $r_{e1}$, $d_1$ and $\epsilon'_1$ are used to signify that the equation relates to the first part of the spectrometer. Therefore, $$\frac{\sin(\phi_{m1} - \epsilon_1')}{\cos\epsilon_1'}\left[\frac{r_{e1}}{r_m}(1 - \cos\sqrt{2}\,\phi_{e1}) + \right. \quad [26]$$

-continued $$\left.\frac{\sqrt{2}\,d_1}{r_m}\sin\sqrt{2}\,\phi_{e1}\right] - \sqrt{2}\sin\sqrt{2}\,\phi_{e1}\cos\phi_{m1} + \sin\phi_{m1} = 0$$

An exactly similar treatment applied to the second part of the spectrometer (parameters $\phi_{e2}$, $\phi_{m2}$, $d_2$, $r_{e2}$, $\epsilon_2'$), leads to equation [27], $$\frac{\sin(\phi_{m2} - \epsilon_2')}{\cos\epsilon_2'}\left[\frac{r_{e2}}{r_m}(1 - \cos\sqrt{2}\,\phi_{e2}) + \right. \quad [27]$$
$$\left.\frac{\sqrt{2}\,d_2}{r_m}\sin\sqrt{2}\,\phi_{e2})\right] - \sqrt{2}\sin\sqrt{2}\,\phi_{e2}\cos\phi_{m2} + \sin\phi_{m2} = 0$$

Equations [26] and [27] are identical to equations [7] and [8] stated previously, and define the essential relationships which have to be satisfied by a three sector spectrometer constructed according to the invention. In the preferred embodiment, $\epsilon_1'=\epsilon_2'=0$ so that equations [9] and [10], stated previously, can be derived. A perfectly symmetrical arrangement, which leads to the most economic manufacture because identical components can be used on each half, has $r_{e1}$, $=r_{e2}$ $(=r_e)$, $\phi_{e1}=\phi_{e2}$ $(=\phi_e)$, $d_1=d_2$ $(=d)$, and $\phi_{m1}=\phi_{m2}$ $(=\phi_m/2)$, which leads to equation [11], also previously stated. When $r_m$ is very much larger than $r_e$ and d, an arrangement especially suited to use with an air cored magnet which requires a very large $r_m$ in order to achieve adequate mass range, the particularly simple equation [12] is obtained, showing that in this case, overall first order velocity focussing is always obtained providing the electrostatic and magnetic sector angles are related to each other by equation [12], independent of the other dimensions of the sectors.

Figure 4:
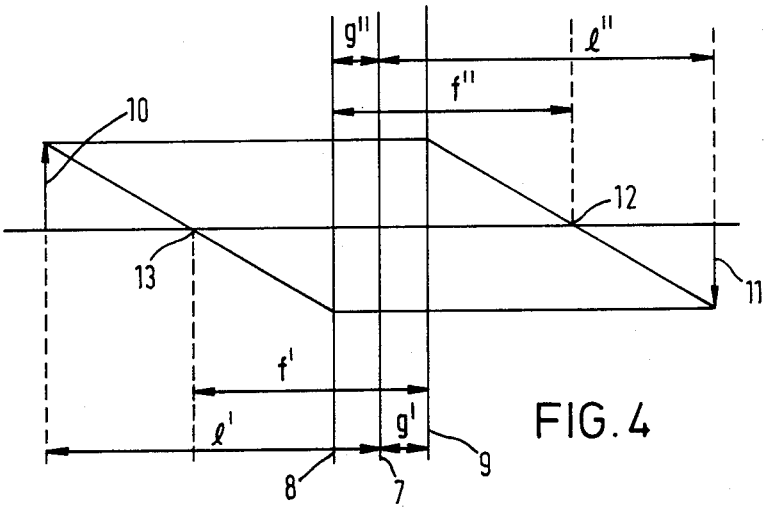
FIG. 4 is a drawing illustrating the application of Newton's formula.

It is next necessary to calculate the positions of the image and object (i.e. the ion detector and the ion source), relative to the sectors, in order to achieve the essential first order direction focusing. This is done in a conventional way using Newton's formula. Referring next to FIG. 4, 7 represents a mechanical boundary of the lens system, 8 and 9 are the principle planes (image and object, respectively), 10 and 11 are the image and object, respectively, and 12 and 13 are the focal points. In a symmetrical arrangement, with equal refractive index on both image and object sides of the lens, $g'=g''=g$, $f'=f''=f$, and equation [28] applies:

$$(1'-g)\,(1''-g)=f^2 \quad [28]$$

In equation [28], 1′ is the distance from the mechanical boundary 7 to the image 10, 1″ is the distance from the mechanical boundary 7 to the object 11, g $(=g'=g'')$ is the distance between the principal planes 8 and 9 and the boundary 7 (g″ and g′, respectively) and f $(=f'=f'')$ is the focal length of the lens measured between the focal point 13 and the object principal plane 9 (f′) or the focal point 12 and the image principal plane 8 (f″).

For a magnetic sector, it is well that $$\frac{f_m}{r_m} = \frac{1}{\tan\phi_m} \quad [29]$$

and

-continued $$\frac{g_m}{r_m} = \frac{1}{\sin\phi_m} \quad [30]$$

if $\epsilon' = \epsilon'' = 0$, and using the same terminology previously applied. The image and object distances (1' and 1'') of the magnetic sector can be obtained by substituting equations [29] and [30] in equation [28] once $r_m$ and $\phi_m$ have been decided.

Similarly, for an electrostatic sector, it is well known that $$\frac{f_e}{r_e} = \frac{1}{\sqrt{2}\tan\sqrt{2}\,\phi_e} \quad [31]$$

and $$\frac{g_e}{r_e} = \frac{1}{\sqrt{2}\sin\sqrt{2}\,\phi_e} \quad [32]$$

Figure 5:
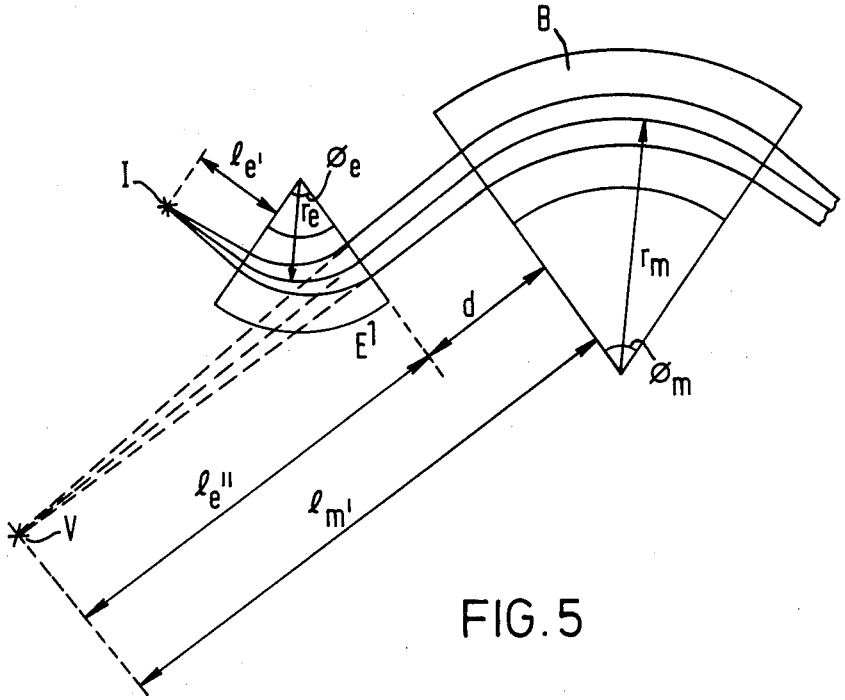
FIG. 5 is a drawing of part of a spectrometer similar to that shown in FIG. 4 and showing the parameters used to obtain first order direction focusing.

Once $\phi_e$ and $r_e$ have been selected, object and image distances can be calculated from equation [28]. As shown in FIG. 5, the first electrostatic sector $E^1$ produces a virtual image V of the ion source I which serves as a virtual object for the magnetic sector B, so that the distance $1_e'$ can be calculated once $\phi_m$, $\phi_e$, $r_m$ and $r_e$ are selected and a convenient value chosen for d. Thus a further advantage of the preferred embodiment is seen. If $r_m$ is greater than 500 mm, and $\phi_m$ typically less than 25°, within a range typical of a non-ferromagnetic cored magnet, then it can be seen from equations [28], [29], and [30] that 1m' will be of the order of 5m–10m. This would of course result in a very large instrument if it were not for the strong focusing action of the electrostatic sectors on either side of it. For a double focusing instrument of the type described, $\phi_e$ is much smaller than $\phi_m$ (from equation [12]), and $r_e$, which does not affect the first order focusing, is much smaller than $r_m$. (This assumption is made in deriving equation [12]). Thus it can be seen that 1e' may be as much as a factor of 10 smaller than 1m', allowing the construction of a compact instrument with a high $r_m$. If further shortening of 1e' is required, this can be achieved by means of additional conventional electrostatic lenses between the ion source and the entrance of the electrostatic sector. In practice, parameters $r_e$ and d are further selected to minimize second order aberrations in the overall double focusing behaviour. The derivation of the focusing equations should present no difficulty to those skilled in the art, following the basic procedure outlined above and using the standard second order matrices for each sector, and the method of minimizing the most important aberrations is well known in the art.

As an alternative to the use of conventional electrostatic lenses to reduce the required image and object distances $1_e'$, it is possible to utilize additional electrostatic sector analysers so that the entire spectrometer becomes a 5 sector instrument having an EEBEE configuration. This combination is made overall double focusing following the procedure outlined above, and results in a very compact instrument of high performance. As explained previously, the length of the electrostatic sectors is so short compared with their radius that in practice straight plates can be used. Consequently, the cost of manufacture of a 5 sector EEBEE instrument is generally no greater than the 3 sector EBE instrument with conventional electrostatic lenses.

As previously explained, the same design principles can be utilized even if the central sector is not a magnetic sector, of if there are an even number of sectors without any intermediate images. For example, the procedure for the design of a BEB type spectrometer with overall double focusing follows the previous procedure almost exactly.

Figure 7:
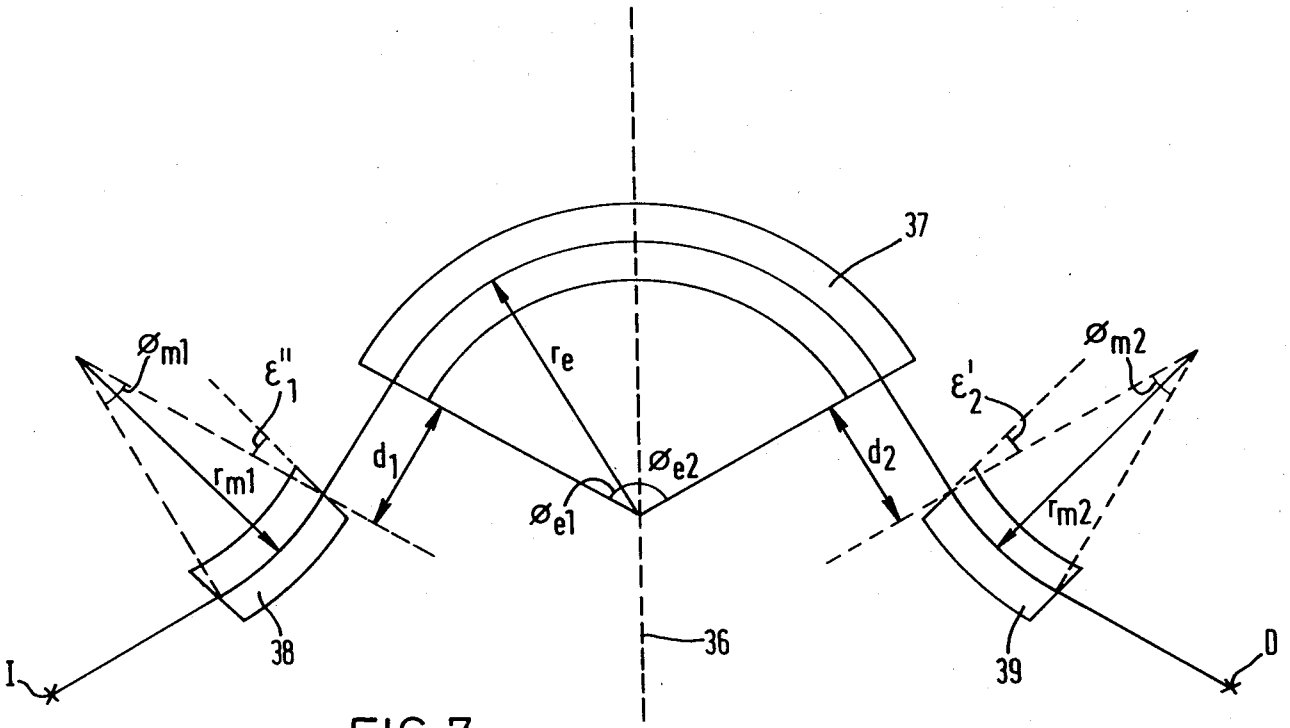
FIG. 7 is a simplified diagram of a spectrometer constructed according to the invention having a BEB configuration.

Referring to FIG. 7, in which a BEB array is provided between ion source I and ion detector D, the boundary 36 is drawn through the centre of the electrostatic sector 37 so that the trajectories of ions of the same m/z ratio but of different energies cross the boundary at right angles to it. The general equation 33 can be derived from the transfer matrices following a similar procedure outlined for the EBE embodiment. In equation 33, the terms having the following significance:

$\phi_{m1}$ is the sector angle of the first magnetic sector 38,
$\phi_{m2}$ is the sector angle of the second magnetic sector 39,
$\phi_{e1}$ is the angle between the entrance boundary of the electrostatic sector 37 and plane 36.
$\phi_{e2}$ is the angle between the exit boundary of electrostatic sector 37 and plane 36,
$r_{m1}$ is the radius of the first magnetic sector 38,
$r_{m2}$ is the radius of the second magnetic sector 39,
$r_e$ is the radius of the electrostatic sector 37,
$d_1$ is the distance between the exit of sector 38 and the entrance of sector 37,
$d_2$ is the distance between the exit of sector 37 and the entrance of sector 38,
$\epsilon_1''$ is the angle between the exit boundary of said first magnetic sector and a normal to the central trajectory at its point of intersection with the exit boundary of said first magnetic sector, and
$\epsilon_2'$ is the angle between the entrance boundary of said second magnetic sector and a normal to the central trajectory at its point of intersection with the entrance boundary of said second magnetic sector.

$$\tan\sqrt{2}\,\phi_{e1} = \frac{\tan\epsilon_1'' + \dfrac{\sin(\phi_{m1}-\epsilon_1'')}{\cos\epsilon_1''}}{\sqrt{2}\left[\dfrac{r_{m1}}{r_e}(1-\cos\phi_{m1}) + \dfrac{d_1}{r_e}\left(\tan\epsilon_1'' + \dfrac{\sin(\phi_{m1}-\epsilon_1'')}{\cos\epsilon_1''} + 1\right)\right]} \quad [33]$$

An exactly similar equation is obtained for the other part of the instrument, and for the symetrical case with $\epsilon'' = 0$, $\phi_{m1} = \phi_{m2} = \phi_m$, $\phi_{e1} = \phi_{e2} = \phi_e/2$, equation [34] follows $$\tan\phi_e/2 = \frac{\sin\phi_m}{\sqrt{2}\left[\dfrac{r_m}{r_e}(1 - \cos\phi_m + \dfrac{d}{r_e}\cdot\sin\phi_m + 1\right]} \quad [34]$$

This is the condition for double focusing, and the positions of the image and object can be found by application of Newton's formulae. Second order corrections can also be applied as explained.

It will be further realized that this method can be used to design spectrometers which have overall double focusing and any number of sectors, providing that at least one magnetic and at least one electrostatic sector are present, and either no intermediate image, or an intermediate image which is only direction focused and not velocity focused, is formed between the sectors.

Figure 6:
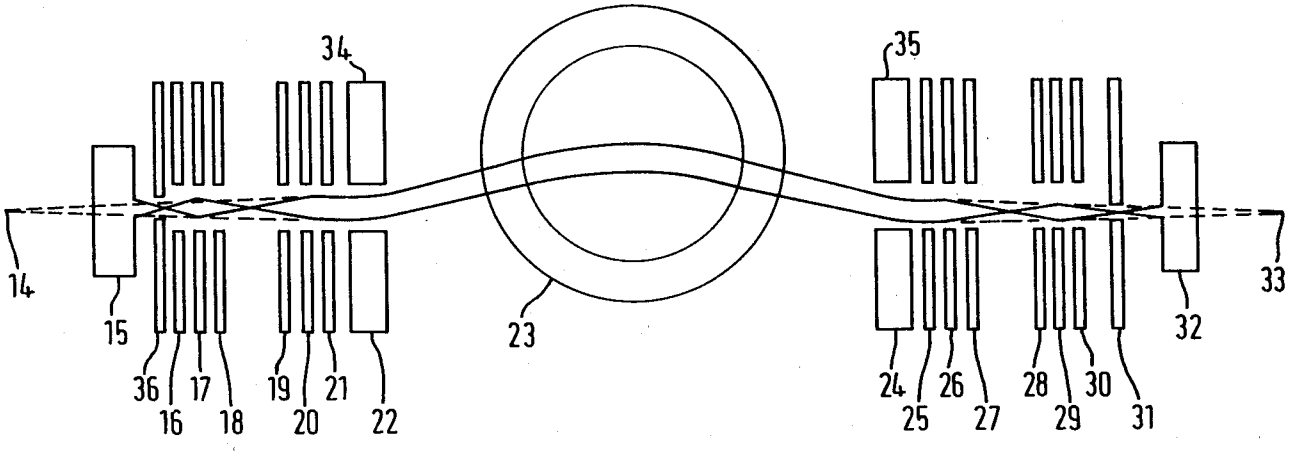
FIG. 6 is a simplified drawing of a practical version of the spectrometer schematically shown in FIG. 3.

Referring next to FIG. 6, in which a practical version of a three sector EBE configuration mass spectrometer according to the invention is illustrated, an ion source 15 generates a beam of ions which passes through the source slit electrode 36 and then an electrostatic zoom lens comprising electrodes 16–21. The ion source 15 may be of any suitable type, eg, electron bombardment, chemical ionization, or fast atom bombardment, and generates a beam of ions with an energy of typically between 2 and 5 keV. The ion source 15 produces a real object for the analyser section which is defined by the object slit of the spectrometer in electrode 36. The slit in this electrode may advantageously be made of adjustable width in order to vary the resolution of the spectrometer, as in a conventional magnetic sector mass spectrometer. The zoom lens comprises two three element conventional electrostatic lenses (electrodes 16,17 and 18, and electrodes 19, 20, 21) arranged in a known fashion in order to shorten the object distance of the spectrometer. Without this lens, the source slit electrode 36 would have to be positioned at point 14, greatly increasing the physical size of the spectrometer. The ion beam then passes through the first electrostatic sector analyser, comprising plates 22 and 34. Assuming that the spectrometer is constructed to the preferred form given in equation [12], with $r_m$ in the range 500 to 2,000 mm, $\phi_m$ between 10 and 30°, and $\phi_e$ calculated from equation [12], it has been previously noted that the value of $r_e$ does not affect the first order focusing behaviour of the spectrometer. Even if $r_e$ is selected to minimize second order aberrations, as is preferred, its value would typically be much less than $r_m$, and the radius of curvature of plates 22 and 34 is thus so large in comparison with the very small sector angle calculated from equation [12] that in practice plates with flat edges can be used. The thickness of plates 22 and 34 then determines $r_e$ in conjunction with the required sector angle. In a practical spectrometer, therefore, electrodes 36, 16–21, and analyser 22, 34 are built in the form of a stack of plates on four ceramic rods mounted from a convenient flange of the spectrometer vacuum housing, and spaced apart by annular ceramic insulators. Obviously, electrodes 16–21 and 36 comprise simple plate electrodes with a rectangular slit-like aperture for the ion beam to pass through, and with the dimensions of the aperture selected according to their function and to well established methods. The electrostatic analyser sector comprises two "half plates" of accurately controlled thickness maintained at a positive and negative potential, respectively, as in a conventional electrostatic analyser.

After leaving the first electrostatic analyser sector the ion beam passes into the magnetic analyser sector 23, which in the preferred embodiment is between 500 and 2000 mm radius. As previously explained a large radius permits the use of an air cored magnet, which may conveniently consist of two spiral coils placed respectively above and below the flight path of the ions. In a more preferred form, copper tape, approximately 35 mm×0.5 mm thick, is used to wind each coil. This allows several hundred amperes to be passed through each coil, resulting in a sufficiently strong magnetic field to permit the instrument to be used for organic chemical analysis. Water cooling of the coils is also desirable, and can be achieved by mounting them between hollow copper plates through which water is circulated. A non-ferromagnetic former may also be used in the centre of each coil, and some improvement in field strength and field homogeneity can be achieved by shaping the coils to correspond approximately with the ion path through the magnetic sector.

Control of the current through the magnet coils, and hence the mass selected by the spectrometer, can be carried out by any suitable method.

After leaving the magnetic sector, the ions pass through a second pair of electrostatic analyser plates 24 and 35, and another zoom lens comprising electrodes 25–30. These components are substantially identical to the first electrostatic analyser and electrodes 16–22, and are disposed in a symmetrical way about the centre of the magnetic field. Electrode 31 is the collector slit of the spectrometer and is preferably made of adjustable width in order to control the resolution of the spectrometer in conjunction with electrode 36. The collector electrode 31 would be situated at point 33 in the absence of the zoom lens comprising electrodes 25–30. Finally, the ions are received on a conventional ion detector 32, which may be an electron multiplier or a Faraday cup detector.

It will be obvious to those skilled in the art that the flight path of the spectrometer, the ion source and ion detector, will be enclosed in a vacuum tight envelope maintained at a pressure of $10^{-4}$ torr or lower by suitable pumping means, e.g. high vacuum pumps. The construction of a suitable vacuum envelope is conventional, but preferably it incorporates rubber "o" ring sealed flanges to facilitate servicing. An additional advantage of using an air cored magnet of the type described is that there is no need to utilize the conventional rectangular flight tube between the poles of the magnet which is necessary with a conventional geometry magnetic sector instrument with an iron cored magnet. In order to obtain adequate field strength in a conventional instrument, the maximum thickness of the tube is strictly limited which reduces the maximum available "z" length of the ion beam in this region. In a conventional instrument, the interior surfaces of this flight tube are of necessity very close to the ion beam, and any contamination accumulating on them can seriously impair the performance of the spectrometer. In the spectrometer of the invention, however, a greater distance between the coils can be tolerated without causing a great reduction in the field strength, so that a circular tube can be employed, in which the surfaces of the tube are more remote from the ion beam, greatly reduced this problem.

It will be understood that the version of the spectrometer illustrated in FIG. 6 is only one example of a spectrometer constructed according to the invention, and that several other methods of construction will occur to those skilled in the art.

I claim:

1. A mass spectrometer having at least three analyzer sectors of the electrostatic or magnetic types, at least one said sector being of the electrostatic type and at least one further of said sectors being of the magnetic type, wherein said spectrometer comprises a focusing sector array comprising at least three of said sectors, said sector of said array being dimensioned and positioned so as to cooperate to form a velocity-focused and direction-focused image and said sectors of said array being so dimensioned and positioned as to form no velocity focused image within said array, and wherein one said sector of said array is disposed adjacent to and between two sectors of the other type.

2. A mass spectrometer having at least three analyser sectors of the electrostatic or magnetic types, at least one said sector being of the electrostatic type and at least one further said sector being of the magnetic type, wherein said spectrometer comprises a focusing sector array comprising at least three of said sectors, said sectors of said array being dimensioned and positioned so as to cooperate to form a velocity- and direction-focused image and said sectors of said array being so dimensioned and positioned as to form no direction focused image in said array.

3. A mass spectrometer according to claim 2 wherein one said sector of said array is disposed adjacent to and between two sectors of the other type.

4. A mass spectrometer according to claim 1 and having a central trajectory along which ions may travel and in which said array comprises two electrostatic sectors and one magnetic sector.

5. A mass spectrometer according to claim 2 and having a central trajectory along which ions may travel and in which said array comprises two electrostatic sectors and one magnetic sector.

6. A mass spectrometer according to claim 4 in which the following relationships are satisfied:

$$\frac{\sin(\phi_{m1}-\epsilon')}{\cos\epsilon'}\left[\frac{r_{e1}}{r_m}(1-\cos\sqrt{2}\,\phi_{e1})+\frac{\sqrt{2}\,d_1}{r_m}\cdot\sin\sqrt{2}\,\phi_{e1}\right]-\sqrt{2}\sin\sqrt{2}\,\phi_{e1}\cos\phi_{m1}+\sin\phi_{m1}=0$$

and $$\frac{\sin(\phi_{m2}-\epsilon'')}{\cos\epsilon''}\left[\frac{r_{e2}}{r_m}(1-\cos\sqrt{2}\,\phi_{e2})+\frac{\sqrt{2}\,d_2}{r_m}\cdot\sin\sqrt{2}\,\phi_{e2}\right]-\sqrt{2}\sin\sqrt{2}\,\phi_{e2}\cos\phi_{m2}+\sin\phi_{m2}=0$$

wherein $r_{e1}$ is the radius of the first electrostatic sector, $r_{e2}$ is the radius of the second electrostatic sector, $r_m$ is the radius of the magnetic sector, $\phi_{e1}$ is the sector angle of said first electrostatic sector, $\phi_{e2}$ is the sector angle of said second electrostatic sector, $\phi_{m1}$ is the angle between a first normal to said central trajectory at its point of intersection with the entrance boundary of said magnetic sector and a plane disposed at right angles to said central trajectory which passes through the point of intersection of said first normal and a second normal to said central trajectory at its point of intersection with the exit boundary of said magnetic sector, $\phi_{m2}$ is the angle between said second normal and said plane, $\epsilon'$ is the angle of inclination of the entrance boundary and of said magnetic sector to said first normal $\epsilon''$ is the angle of inclination of the exit boundary of said magnetic sector to said second normal, $d_1$ is the distance between the exit boundary of said first electrostatic sector and the entrance boundary of said magnetic sector, measured along said central trajectory, and $d_2$ is the distance between the exit boundary of said magnetic sector and the entrance boundary of said second electrostatic sector, measured along said central trajectory.

7. A mass spectrometer according to claim 5 in which the following relationship is satisfied:

$$\tan\frac{\phi_m}{2}=\frac{\sqrt{2}\sin\sqrt{2}\,\phi_e}{\frac{r_e}{r_m}(1-\cos\sqrt{2}\,\phi_e)+\frac{\sqrt{2}\,d}{r_m}\cdot\sin\sqrt{2}\,\phi_e+1}$$

in which $\phi_m=2\phi_{m1}=2\phi_{m2}$, $\phi e=\phi e1=\phi_{e2}$, $d=d_1=d_2$, $r_e=r_{e1}=r_{e2}$, and $r_m$, $\phi_{m1}$, $\phi_{m2}$, $\phi_{e1}$, $\phi_{e2}$, $d_1$ and $d_2$ are as defined in claim 6.

8. A mass spectrometer according to claim 5 in which d and $r_e$ are both at least five times smaller than $r_m$ and the following relationship is approximately satisfied:

$$\tan\frac{\phi_m}{2}=\sqrt{2}\sin\sqrt{2}\,\phi_e$$

in which $d=d_1=d_2$, $r_e=r_{e1}=r_{e2}$, $\phi_m=2\phi_{m1}=2\phi_{m2}$, $\phi_e=\phi_{e1}=\phi_{e2}$ and $d_1$, $d_2$, $r_{e1}$, $r_{e2}$, $r_m$, $\phi_{m1}$, $\phi_{m2}$, $\phi_{e1}$ and $\phi_{e2}$ are as defined in claim 6.

9. A mass spectrometer according to claim 1 and having a central trajectory along which ions may travel and in which said array comprises an electrostatic sector and two magnetic sectors, and in which the following equations are satisfied:

$$\sqrt{2}\tan\sqrt{2}\,\phi_{e1}\left[\frac{r_{m1}}{r_e}(1-\cos\phi_{m1})+\frac{d_1}{r_e}\tan\epsilon_1''+\frac{\sin(\phi_{m1}-\epsilon_1'')}{\cos\epsilon_1''}+1\right]-\left[\tan\epsilon_1''+\frac{\sin(\phi_{m1}-\epsilon_1'')}{\cos\epsilon_1''}\right]=0$$

and $$\sqrt{2}\tan\sqrt{2}\,\phi_{e2}\left[\frac{r_{m2}}{r_e}(1-\cos\phi_{m2})+\frac{d_2}{r_e}\tan\epsilon_2'+\frac{\sin(\phi_{m2}-\epsilon_2')}{\cos\epsilon_2'}+1\right]-\left[\tan\epsilon_2'+\frac{\sin(\phi_{m2}-\epsilon_2')}{\cos\epsilon_2'}\right]=0$$

in which $\phi_{m1}$ is the sector angle of the first magnetic sector, $\phi_{m2}$ is the sector angle of the second magnetic sector, $\phi_{e1}$ is the angle between a first normal to said central trajectory at its point of intersection with the entrance boundary of said electrostatic sector and a plane disposed at right angles to said central trajectory which passes through the point of intersection of said first normal and a second normal to said central trajectory at its point of intersection with the exit boundary of said electrostatic sector, $\phi_{e2}$ is the angle between said second normal and said plane, $r_{m1}$ is the radius of the said first magnetic sector, $r_{m2}$ is the radius of the said second magnetic sector, $r_e$ is the radius of said electrostatic sector, $d_1$ is the distance between the exit boundary of said first magnetic sector and the entrance boundary of said electrostatic sector, measured along said central trajectory, and $d_2$ is the distance between the exit boundary of said electrostatic sector and the entrance boundary of said second magnetic sector, measured along said central trajectory, $\epsilon_1''$ is the angle between the exit boundary of said first magnetic sector and a normal to the central trajectory at its point of intersection with the exit boundary of said first magnetic sector, and $\epsilon_2'$ is the angle between the entrance boundary of said second magnetic sector and a normal to the central trajectory at its point of intersection with the entrance boundary of said second magnetic sector.

10. A mass spectrometer according to claim 9 in which $\epsilon_1''=\epsilon_2'=0$, $\phi_{m1}=\phi_{m2}$, $\phi_{e1}=\phi_{e2}=\phi_e$, $d_1=d_2$ and $r_{m1}=r_{m2}$.

11. A mass spectrometer according to claim 4 comprising an ion source and an ion detector and in which at least one electrostatic lens is disposed between said source and the first sector of said array and at least one electrostatic lens is disposed between the last sector of said array and said ion detector, said electrostatic lenses being arranged to reduce the object distance of said first sector and the image distance of said last sector, respectively.

12. A mass spectrometer according to claim 5 comprising an ion source and an ion detector in which at least one electrostatic lens is disposed between said ion source and the first sector of said array and at least one electrostatic lens is disposed between the last sector of said array and said ion detector, said electrostatic lenses being arranged to reduce the object distance of said first sector and the image distance of said last sector, respectively.

13. A mass spectrometer according to claim 6 comprising an ion source and an ion detector in which at least one electrostatic lens is disposed between said ion source and the first sector of said array and at least one electrostatic lens is disposed between the last sector of said array and said ion detector, said electrostatic lenses being arranged to reduce the object distance of said first sector and the image distance of said last sector, respectively.

14. A mass spectrometer according to claim 9 comprising an ion source and an ion detector in which at least one electrostatic lens is disposed between said ion source and the first sector of said array and at least one electrostatic lens is disposed between the last sector of said array and said ion detector, said electrostatic lenses being arranged to reduce the object distance of said first sector and the image distance of said last sector, respectively.

15. A mass spectrometer according to claim 1 in which at least one said sector of said array is a magnetic sector provided with an electromagnet having a core of a non-ferromagnetic material.

16. A mass spectrometer according to claim 2 in which at least one said sector of said array is a magnetic sector provided with an electromagnet having a core of a non-ferromagnetic material.

17. A mass spectrometer according to claim 4 in which at least one said sector of said array is a magnetic sector provided with with an electromagnet having a core of a non-ferromagnetic material.

18. A mass spectrometer according to claim 5 in which at least one said sector of said array is a magnetic sector provided with with an electromagnet having a core of a non-ferromagnetic material.

19. A mass spectrometer according to claim 6 in which at least one said sector of said array is a magnetic sector provided with with an electromagnet having a core of a non-ferromagnetic material.

20. A mass spectrometer according to claim 9 in which at least one said sector of said array is a magnetic sector provided with with an electromagnet having a core of a non-ferromagnetic material.

21. A mass spectrometer according to claim 15 in which said electromagnetic comprises two substantially flat coils disposed either side of the plane in which ions travel during their passage through said magnetic sector.

22. A mass spectrometer according to claim 16 in which said electromagnet comprises two substantially flat coils disposed either side of the plane in which ions travel during their passage through said magnetic sector.

23. A mass spectrometer according to claim 17 in which said electromagnet comprises two substantially flat coils disposed either side of the plane in which ions travel during their passage through said magnetic sector.

24. A mass spectrometer according to claim 18 in which said electromagnet comprises two substantially flat coils disposed either side of the plane in which ions travel during their passage through said magnetic sector.

25. A mass spectrometer according to claim 19 in which said electromagnet comprises two substantially flat coils disposed either side of the plane in which ions travel during their passage through said magnetic sector.

26. A mass spectrometer according to claim 20 in which said electromagnet comprises two substantially flat coils disposed either side of the plane in which ions travel during their passage through said magnetic sector.

* * * * *